US007350837B1

(12) United States Patent
Faires

(10) Patent No.: US 7,350,837 B1
(45) Date of Patent: Apr. 1, 2008

(54) DOOR JAM SECURITY DEVICE AND METHOD OF USING SAME

(76) Inventor: Charles W. Faires, 3371 Richlands Hwy., Jacksonville, NC (US) 28540

( * ) Notice: Subject to any disclaimer, the term of this patent is extended or adjusted under 35 U.S.C. 154(b) by 0 days.

(21) Appl. No.: 11/585,012

(22) Filed: Oct. 23, 2006

(51) Int. Cl.
*E05C 19/00* (2006.01)

(52) U.S. Cl. ..... 292/259 R; 292/260

(58) Field of Classification Search ..... 292/288, 292/292, 259 R, 260
See application file for complete search history.

(56) References Cited

U.S. PATENT DOCUMENTS 862,908 A * 8/1907 Hawkinson ..... 292/258
3,821,884 A * 7/1974 Walsh ..... 70/95
D275,550 S 9/1984 Johnson
4,671,014 A 6/1987 Lack
4,779,910 A 10/1988 Dameron
4,856,831 A * 8/1989 Roden, Jr. ..... 292/259 R
5,253,905 A 10/1993 Hutson
5,364,140 A * 11/1994 Rice ..... 292/259 R
5,605,364 A 2/1997 Shelledy
5,826,923 A 10/1998 Bethurem
6,131,968 A * 10/2000 Bruce ..... 292/259 R

* cited by examiner

*Primary Examiner*—Gary Estremsky
(74) *Attorney, Agent, or Firm*—Kyle Fletcher

(57) ABSTRACT

The invention is a special bar assembly that could be easily installed on a steel door of a commercial building. The invention comprises a permanent door piece, door mounting hardware, and a lock piece assembly. The secure bar when in a locked position will keep the door from opening by impacting the door jam of the door that it is attached too. To unlock the secure bar simply detach and remove the lock piece assembly. A second embodiment of the secure bar enjoys all the same parts, and features with the exception of a longer lock piece for use on a double-door configuration.

6 Claims, 7 Drawing Sheets

DOOR JAM SECURITY DEVICE AND METHOD OF USING SAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to a special bar assembly that could be easily installed on a steel door of a commercial building.

Typically a back or side door of a commercial building is especially vulnerable to security breaches. This invention seeks to eliminate security breaches at said doors. The invention would have sufficient structural strength to stop any attempted break-ins by serving as a large angle brace for a door.

B. Prior Art

The Lack patent (U.S. Pat. No. 4,671,014) is directed to a very secure entry door barricade system that is obtained with a specially configured elongated bar which extends horizontally across the width of a door.

The Shelledy patent (U.S. Pat. No. 5,605,364) is directed towards a barricade to prevent a door from being opened and entry gained by an unauthorized or unwanted person.

The Rice patent (U.S. Pat. No. 5,364,140) is directed towards a door security apparatus for barricading a door shut.

The Hutson patent (U.S. Pat. No. 5,253,905) is directed towards a door locking system for attachment to an outwardly opening door which engages the door frame and which has a panic bar movable towards the door for disengaging the locking system.

The Dameron patent (U.S. Pat. No. 4,779,910) is directed towards a security bar maintaining the closure of a hinged door.

The Bethurem patent (U.S. Pat. No. 5,826,923) is directed towards a door security apparatus which uniquely bars a door open in a closed position.

The Johnson et al. patent (U.S. Pat. No. Des. 275,550) illustrates a design for a door locking bar.

BRIEF SUMMARY OF THE INVENTION

The invention is a special bar assembly that could be easily installed on a steel door of a commercial building. The invention comprises a permanent door piece, door mounting hardware, and a lock piece assembly. The secure bar when in a locked position will keep the door from opening by impacting the door jam of the door that it is attached too. To unlock the secure bar simply detach and remove the lock piece assembly. A second embodiment of the secure bar enjoys all the same parts, and features with the exception of a longer lock piece for use on a double-door configuration.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
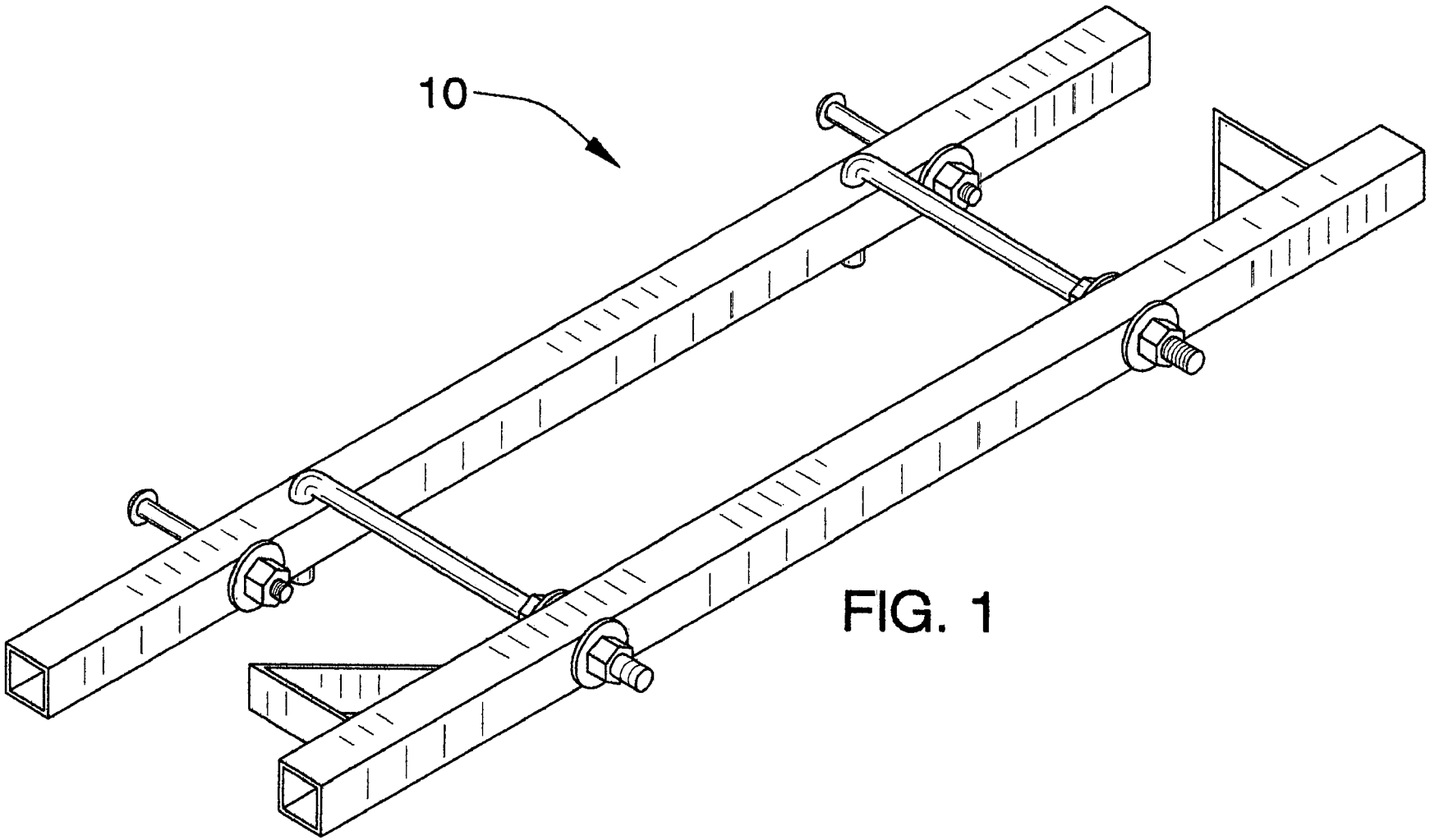
FIG. 1 illustrates an isometric rendering of the invention by itself.
Figure 2:
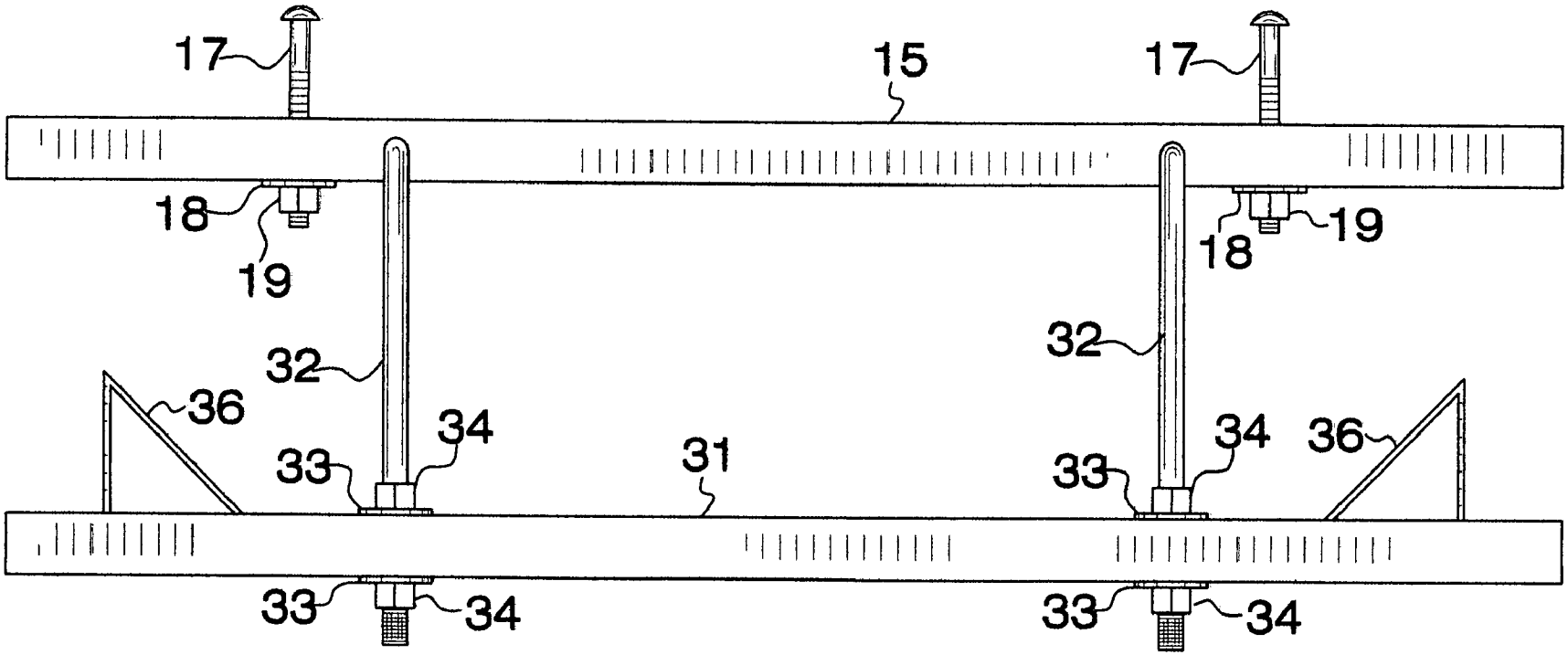
FIG. 2 illustrates a top view of the invention by itself.
Figure 3:
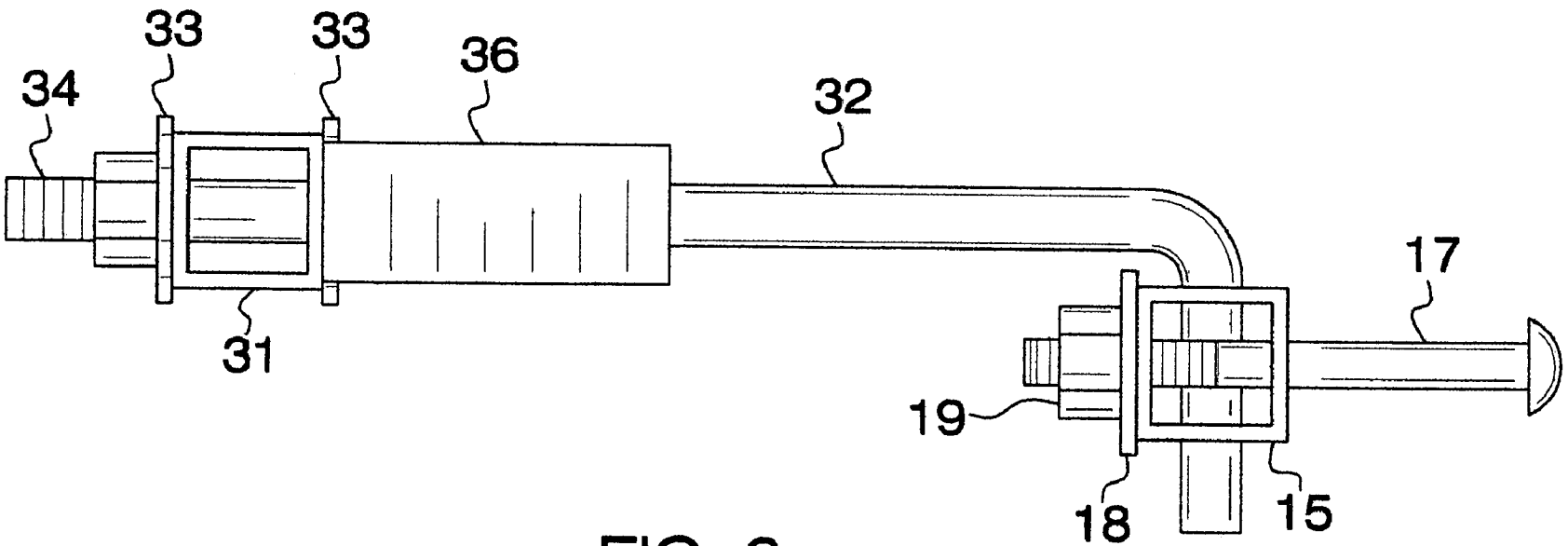
FIG. 3 illustrates a right-side view of the invention by itself.
Figure 4:
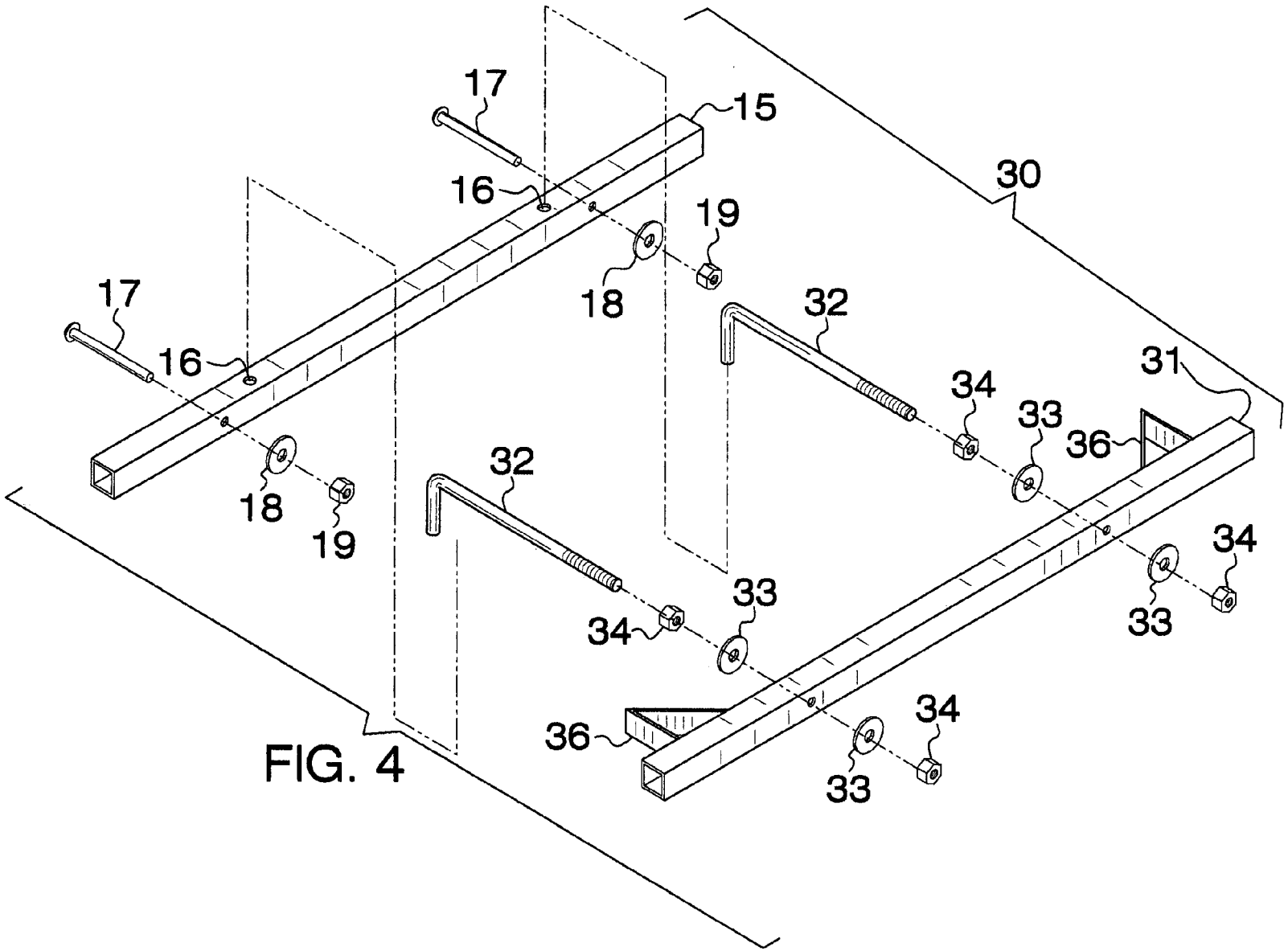
FIG. 4 illustrates an exploded isometric view of the invention by itself.
Figure 5:
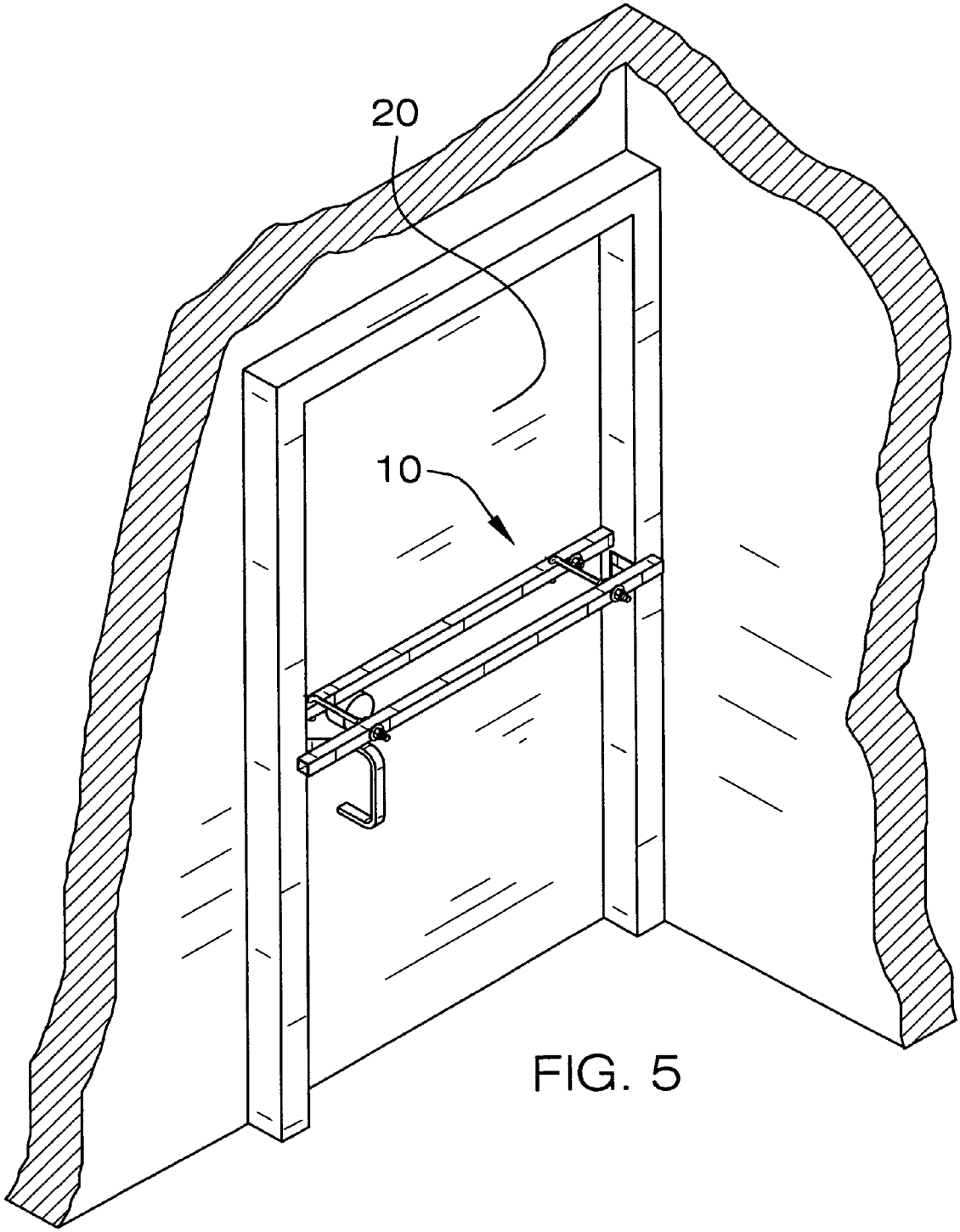
FIG. 5 illustrates an isometric rendering of the invention in a locked position against a commercial door.
Figure 6:
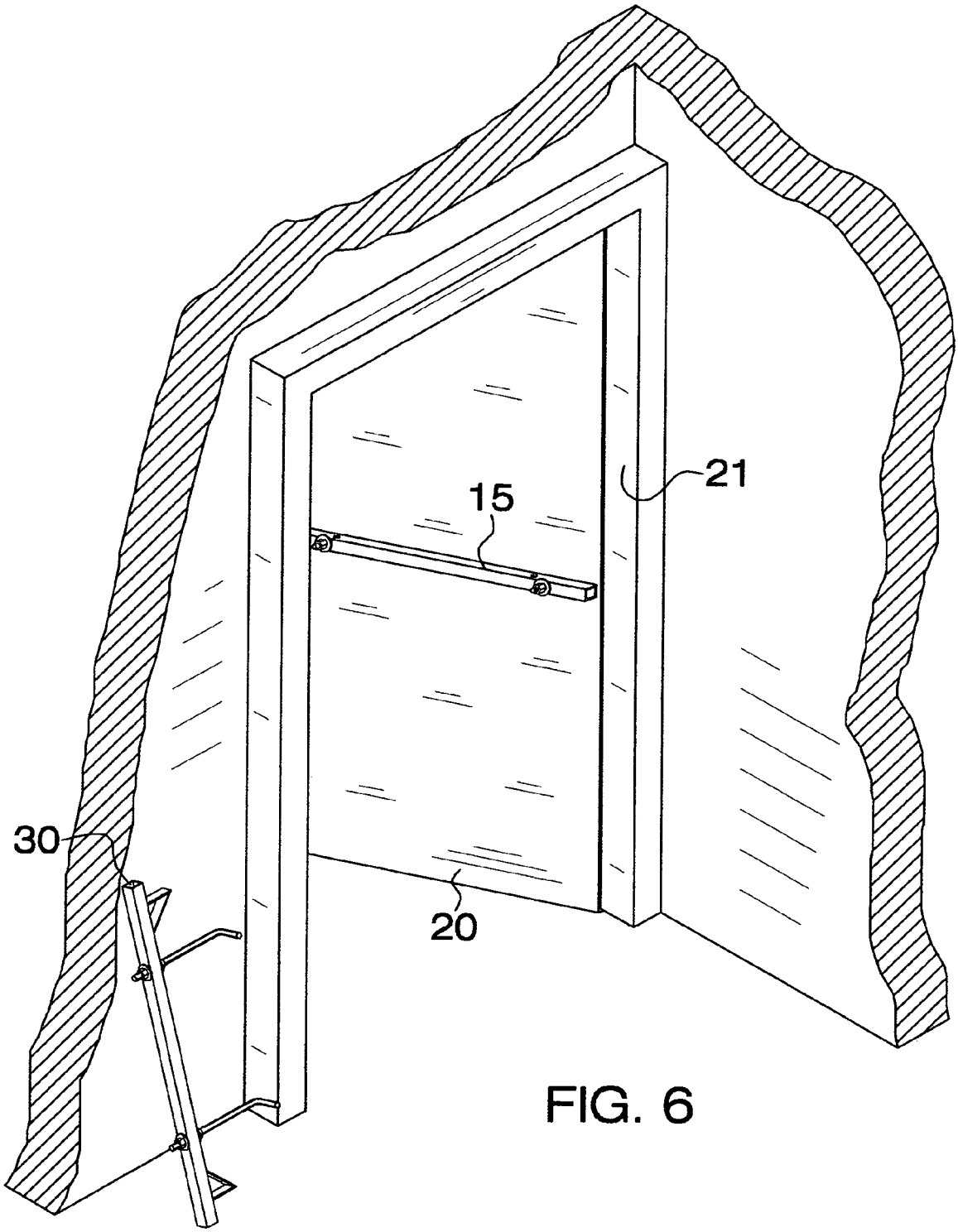
FIG. 6 illustrates an isometric rendering of the invention in an unlocked position.

Detailed reference will now be made to the preferred embodiments of the present invention, examples of which are illustrated in the accompanying drawings. Referring to FIGS. 1-6, a secure bar 10 involves a permanent door piece 15, which is connected to a commercial door 20 by door mounting hardware. The door mounting hardware comprises a carriage bolt 17, a washer 18, and a nut 19.

The secure bar 10 is put into a locked position when a door jam assembly 30 is attached. The door jam assembly 30 comprises a lock piece 31, a plurality of "L" bolts 32, a corresponding number of "L" bolt lock holes 35 located on the lock piece 31, a series of lock piece washers 33, and a series of lock piece nuts 34. The lock piece 31 has a door jam brace 36 attached at each end. The door jam brace may be attached by a means comprising welding, bolting, or casting the parts together. The "L" bolts 32 are connected to the lock piece 31 by placing the "L" bolt 32 through a corresponding "L" bolt lock piece hole 35 located on the lock piece 31. The "L" bolt is secured to the lock piece 31 by a series of lock piece washers 33 and lock piece nuts 34. The "L" bolt 32 may also be securely connected to the lock piece 31 by welding or casting the parts together.

The Secure bar 10 is in the locked position when the ends of the "L" bolts 32 of the lock piece assembly 30 are placed into an "L" bolt permanent hole 16. The lock piece assembly 30 secures the commercial door 20 with the door jam brace 36 impacting a door jam 21. When the unit is to be unlocked, simply detach and remove the lock piece assembly 30 from the permanent door piece 15.

Figure 7:
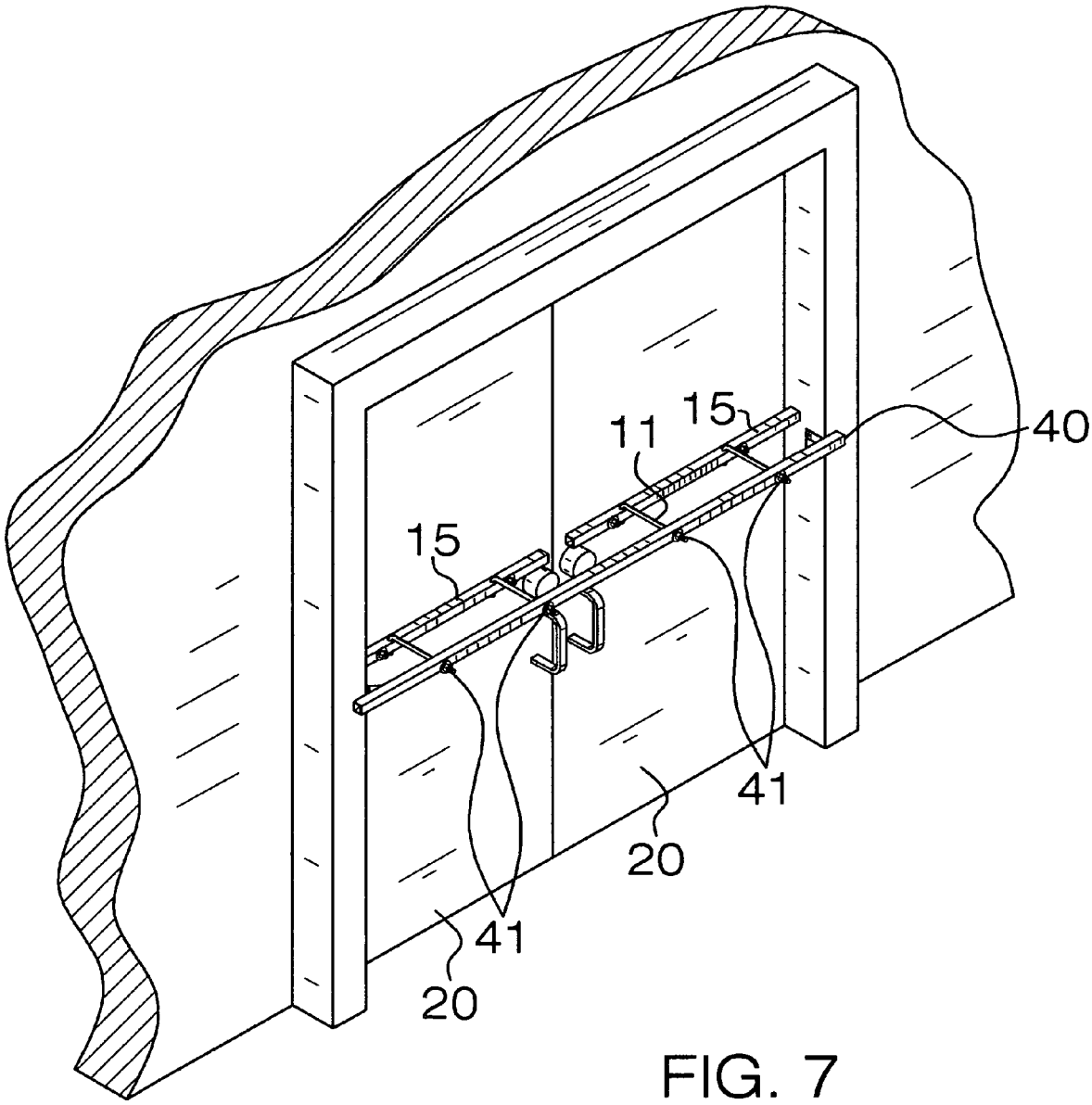
FIG. 7 illustrates an isometric rendering of another embodiment of the invention in use and in a locked position against two commercial doors.

Detailed reference will now be made to a second embodiment of the present invention, an example of which is illustrated in FIG. 7. In a setting involving two doors, the longer secure bar 11 would involve two permanent door pieces 15 be attached in the same manner as mentioned above. This embodiment requires a longer lock piece 40 with a plurality of "L" bolt longer lock piece holes 41, and is attached in the same manner as mentioned above for the lock piece assembly 30. The longer secure bar 11 is placed in a locked position in the same manner as described above for the secure bar 10. The two-door configuration would prevent the doors from opening in the same way as previously discussed with the first embodiment.

The invention claimed is:

1. A secure bar comprising:

(a) a permanent door piece;

wherein the permanent door piece is permanently attached to a single door using a fastening means;

wherein the permanent door piece has a plurality of vertical holes;

(b) a plurality of "L" bolts;

wherein there is a same number of "L" bolts and vertical holes;

(c) a lock piece;

wherein the "L" bolts are permanently secured to the lock piece by a fastening means;

wherein each of the "L" bolts are spaced on the lock piece in order to align with the vertical holes of the permanent door piece;

(d) a pair of door jam braces;

wherein each door jam brace is permanently fastened near each of the two ends of the lock piece;

wherein the door jam braces and the lock piece form right angle triangles near each end of the lock piece;

wherein each door jam brace and "L' bolt are positioned along the interior surface of the lock piece; and wherein the door jam brace and the lock piece are positioned against the door jam of the door via the right triangles near each end of the lock piece and upon installation of the lock piece via the "L" bolts being inserted into the holes of the permanent door piece.

2. The device as described in claim 1 wherein the fastening means comprises welding, bolting, screwing, molding, and casting.

3. The device as described in claim 1 wherein the permanent door piece, the "L" bolts, the lock piece, and the door jam braces are made from a metal.

4. A double secure bar comprising:

(a) a pair of permanent door pieces;

wherein each of the two permanent door pieces are permanently attached to one of two doors in which both doors form a double door entrance;

wherein each of the two permanent door pieces are permanently attached to one of the two doors using a fastening means;

wherein the permanent door pieces each have a plurality of vertical holes;

(b) a plurality of "L" bolts;

wherein there is a same number of "L" bolts and vertical holes;

(c) a lock piece;

wherein the "L" bolts are permanently secured to the lock piece by a fastening means;

wherein each of the "L" bolts are spaced on the lock piece in order to align with the vertical holes of both of the permanent door pieces;

(d) a pair of door jam braces;

wherein each door jam brace is permanently fastened near each of the two ends of the lock piece;

wherein the door jam braces and the lock piece form right angle triangles near each end of the lock piece;

wherein each door jam brace and "L' bolt are positioned along the interior surface of the lock piece; and wherein the door jam brace and the lock piece are positioned against the door jam of the double door entrance via the right triangles near each end of the lock piece and upon installation of the lock piece via the "L" bolts being inserted into the holes of the permanent door piece.

5. The device as described in claim 4 wherein the fastening means comprises welding, bolting, screwing, molding, and casting.

6. The device as described in claim 4 wherein the permanent door piece, the "L" bolts, the lock piece, and the door jam braces are made from a metal.

* * * * *